United States Patent [19]

Kiehl

[11] 4,326,718

[45] Apr. 27, 1982

[54] GOLF SWING TRAINING AND EXERCISING DEVICE

[76] Inventor: Arthur H. Kiehl, 534 Carson Dr., Hendersonville, N.C. 28739

[21] Appl. No.: 178,884

[22] Filed: Aug. 18, 1980

[51] Int. Cl.[3] ..... A63B 69/36

[52] U.S. Cl. ..... 273/183 B; 273/186 R; 273/190 R; 273/187 R

[58] Field of Search ..... 273/186 R, 186 RA, 186 A, 273/191 R, 189 R, 190 R, 191 A, 191 B, 192, 187 R

[56] References Cited

U.S. PATENT DOCUMENTS

| | | | |
|---|---|---|---|
| 3,415,523 | 12/1968 | Boldt | 273/186 R |
| 3,876,212 | 4/1975 | Oppenheimer | 273/191 R X |
| 4,137,566 | 1/1979 | Haas et al. | 273/186 RA X |

*Primary Examiner*—George J. Marlo

[57] ABSTRACT

A golf swing training and exercising device comprises a vertical tubular member having a telescopic complementary tubular member for adjusting the height of the device, a tubular swing arm having another tubular member and a complementary member insertable therein to adjust the length of a swing arm, electrical signaling apparatus comprising a plurality of spaced switches which are in closed position when in contact with a cam housed on the swing arm. Certain signals are actuated by forward and backward movement of a grip, and other signals are actuated by rotary movement of the grip. Some signals indicate when a proper address, swing and follow through are made. A certain different set of signals indicate when a "fat" or "light" hit is made during a swing. The device, optionally, has a head restraining device which has an electrical switch that is adjustable for an allowable degree of head movement before it is closed to activate a signal indicating excessive head movement. The training and exercising device can be used with or without a golf club and with or without a golf ball or a practice substitute for a golf ball. A variable tension can be applied on a braking system to exercise and improve the strength of muscles employed during the swing. The device may also include a weight shift signal element wherein electrical switches are operated upon predetermined and timely weight shift from one foot to the other.

25 Claims, 13 Drawing Figures

GOLF SWING TRAINING AND EXERCISING DEVICE

BACKGROUND OF THE INVENTION

Several attempts have been made to design a golf swing perfecting or exercising device, but each of the prior art devices falls short of providing a unit which will inform a golfer whether a certain swing would result in having a club face meet a ball squarely and at the right distance from the ground. Additionally, no prior art mechanism has an indicator to show whether a particular swing was perfect or if it resulted in a hook or a slice or if it was topped or undercut. No prior art discloses any means for determining whether a club face is in proper alignment with a ball prior to a swing, nor whether the proper follow through is effected.

All the above shortcomings are solved by my device and are objects of my invention.

SUMMARY OF THE INVENTION

The golf swing perfecting or exercising device is useful for either indicating immediately by means of a signaling member whether a golf swing address, back swing, contact with the ball and follow through are substantially perfect or whether one or more segments of the swing, and specifically the actual segment or segments, was imperfect.

The device also contains a braking mechanism which is adjustable as to the amount of resistance that is applied to a swing to enable an individual to strengthen the muscles needed for swinging a golf club and thereby increase or improve the distance attainable from hitting a golf ball. The braking mechanism is also adjustable to apply tension at any desired predetermined position of a swing.

The signaling system of the device is electrically operated by a plurality of microswitches and cams which are operative to inform the user of the device when the club face is positioned to meet the ball squarely during the time of addressing and hitting the ball by means of one set of signals, and by different sets of signals, each operative to tell whether a swing would result in a hook, a slice, a light hit on top of the ball or whether the hit was "fat" or undercut.

The device of this invention also has a head restraining member to keep the golfer's "eye on the ball" during a golf swing.

An additional feature of the device is a member for adjusting the position of the golf stance for various iron shots and adjusting for an "inside-out" swing for both right and left handed golfers.

DETAILED DESCRIPTION OF THE INVENTION

Figure 1:
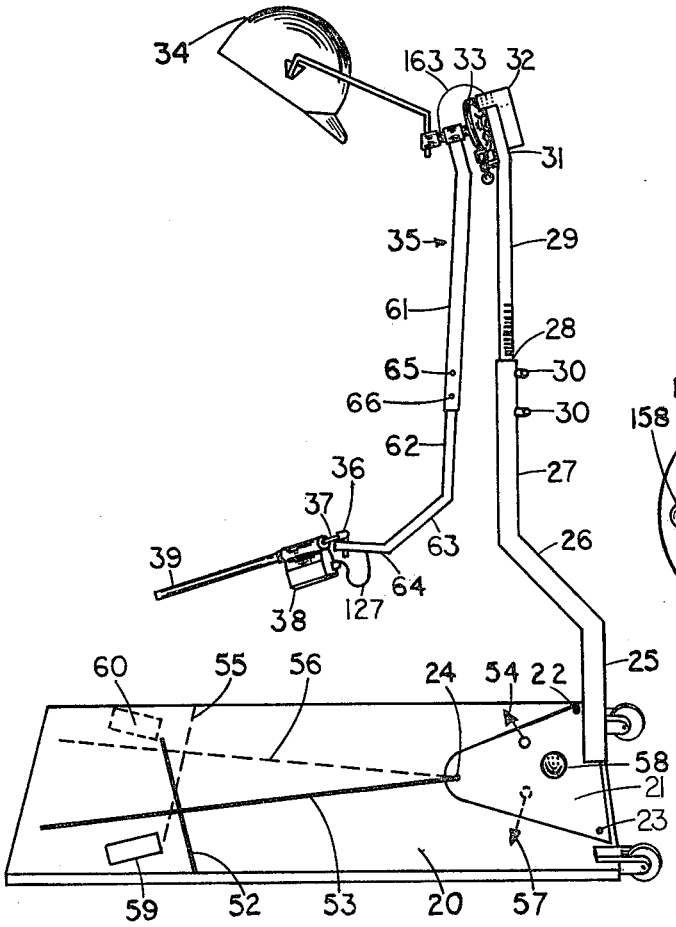
FIG. 1 is an elevation of the device of this invention.
Figure 12:
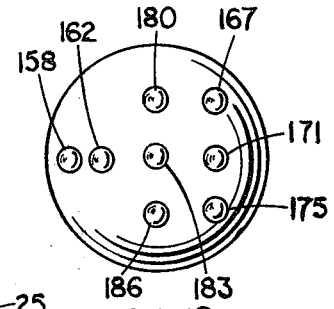
FIG. 12 is a plan view of the signal panel.

Referring to FIG. 1, the device of my invention comprises a base plate, 20, which can be metal, plywood, or a structural plastic. The base plate, 20, is connected to a support, 21, by means of screws 22,23,24 or rivets, or it can be welded to a metal base plate. A vertical tubular member, 25, which can be made of metal such as a ferrous metal, aluminum or of a structural nylon or epoxy resin, is connected to support, 21, on base plate, 20, by means of screws (not shown) or it can be welded if made of a ferrous metal such as iron, steel, or the various stainless steel. Tubular member, 25, has an inwardly bent section, 26, and another bent section, 27, to a vertical position. Section 27, terminates at 28, which is approximately $\frac{1}{3}$ to $\frac{2}{3}$ the height of the device. A complementary tubular member, 29, having outer measurements slightly smaller than the inner measurement of member, 27, fits slidably into tubular section 27. Member 27 can have a plurality of space openings or indentations through which a pin, 30, or a lock screw (not shown) can be inserted after adjusting the height of the device for any particular person. Member 29 has an inwardly bent section, 31, at its top. Section 31 is connected to a source of electrical energy, 32, a brake mechanism, 33, a head restraining member, 34, and a swing arm, 35, which is adjustable for length, as will be shown in more detail hereafter.

Attached to the end of arm 35 is a toggle, 36, that is connected by a rod, 37, to a signal box, 38, and to a grip, 39.

Figure 2:
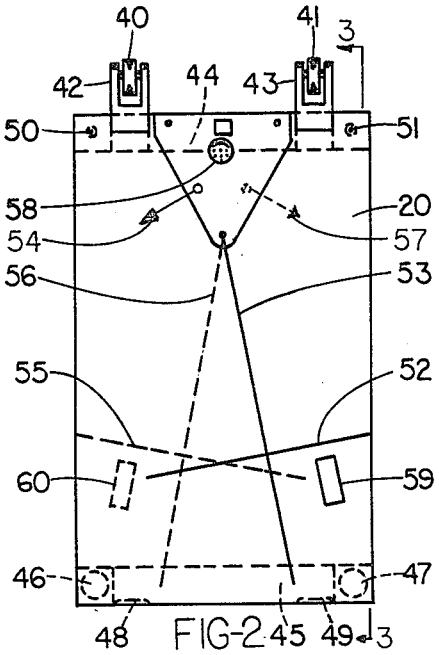
FIG. 2 is a plan view of the base of the device.
Figure 3:
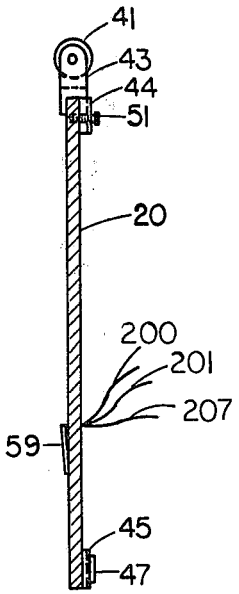
FIG. 3 is a section taker along lines 3—3 of FIG. 2.

FIGS. 2 and 3 show details of one modification of a base plate 20. The numerals 40,41 represent rollers set slightly above the ground or a floor in brackets, 42,43 attached to the plate 20 by means of screws or rivets (not shown). At the front and back of the base plate are cross members 44,45 for additional strength. Adjacent to the front cross member 45, are a pair of pads 46,47 made of rubber or other elastomer to limit slippage of the unit on the ground or floor. The front of the base plate can also have a pair of hollow sections 48, 49 for easy gripping to facilitate moving of the practice unit.

At the rear of the base plate are two leveling jacks 50, 51 for properly positioning the unit on slightly uneven surfaces.

A right handed golfer places his feet along line 52 and straddle line 53. Line 52 is substantially parallel to the flight of a squarely hit golf ball, as designated by arrow 54.

Similarly, broken line 55, and dividing broken line 56 are used for placing of the feet of a left handed golfer and line 55 is substantially parallel to the flight 57 of a squarely hit ball by a left handed golfer. The base plate carries a signal device 58, which is described in detail hereafter. Optionally, the base can have a weight shift signalling device 59, 60 mounted under the rear foot of the golfer as he addresses a ball or it can be a separate unit placed on the floor beneath the base. The weight shift signaling device indicates that the proper weight shift has taken place on the backswing and just prior to impact of a club with a golf ball. The device comprises an electrical switch having upper and lower contacts. The switch is opened and closed in response to tension on an adjustable spring. The weight shift signal can be connected to the positive or negative side of the signal circuit, and the tension on the spring can be set so that proper weight shift must occur before the signal is operable or it can be arranged so that other signals will not operate if the proper weight shift does not occur. The switch is open when the weight is about equally distributed on both feet. It is closed when a significant predetermined weight is shifted to the rear foot, thus allowing the backswing circuit to be completed. A significant and predetermined weight shift to the front foot of the golfer just prior to impact of a club with the ball will also close a circuit to activate a signal.

The swing arm 35 (FIG. 1) has a tubular section 61, into which section 62 can be inserted. The latter has bent sections 63,64 so that the swing arms at this point is substantially parallel with base 20. Section 61 has a pair of openings 65,66 for placement of set screws, pins or other devices needed for adjusting the length of the swing arm.

Figure 4:
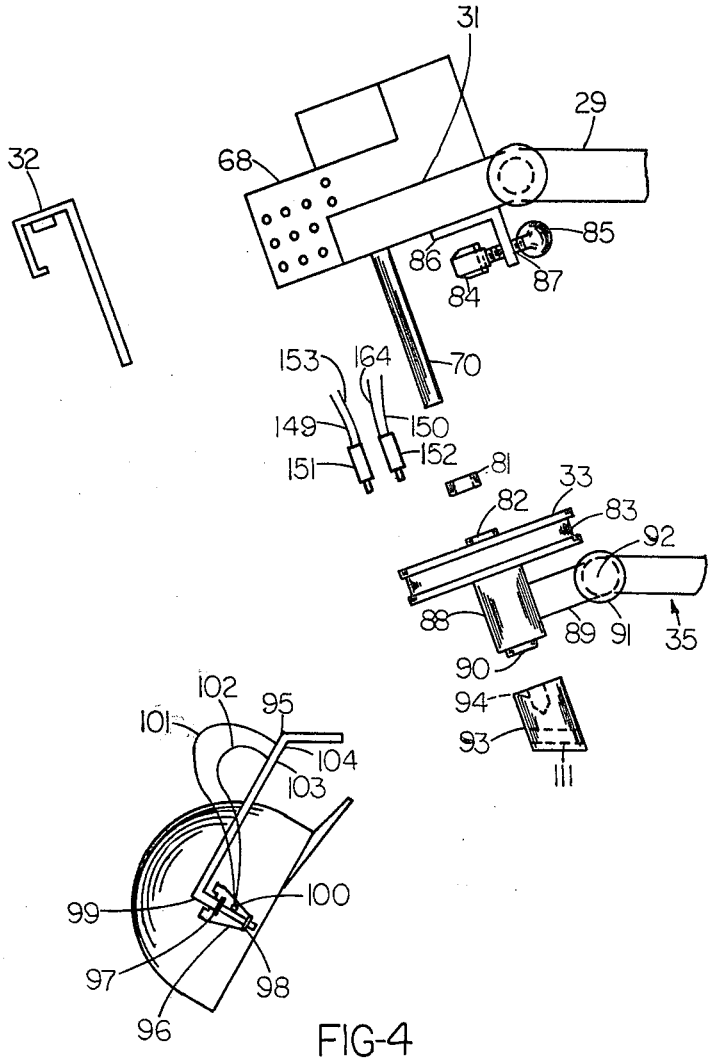
FIG. 4 is an exploded view of the braking mechanism, a pivot at the top of the device and the head restraint.

At the top of the golf training device of this invention, as shown in FIG. 4, is a source of energy 32, for example a battery holder or a connection to a 110–120 volt household current source. If the source is a battery holder, it is connected to section 31 by any means, such as a screw (not shown). At the top of or adjacent to, optionally, is a terminal board 68, for connecting electrical wires to make proper contact for each signal, as will be hereafter disclosed in greater detail.

If a terminal board is used, a series of electrical wires projects from the terminal board at the top of the unit. If no terminal board is used the wires are passed over the top of the unit and down along the support to the signal device 58.

Figure 5:
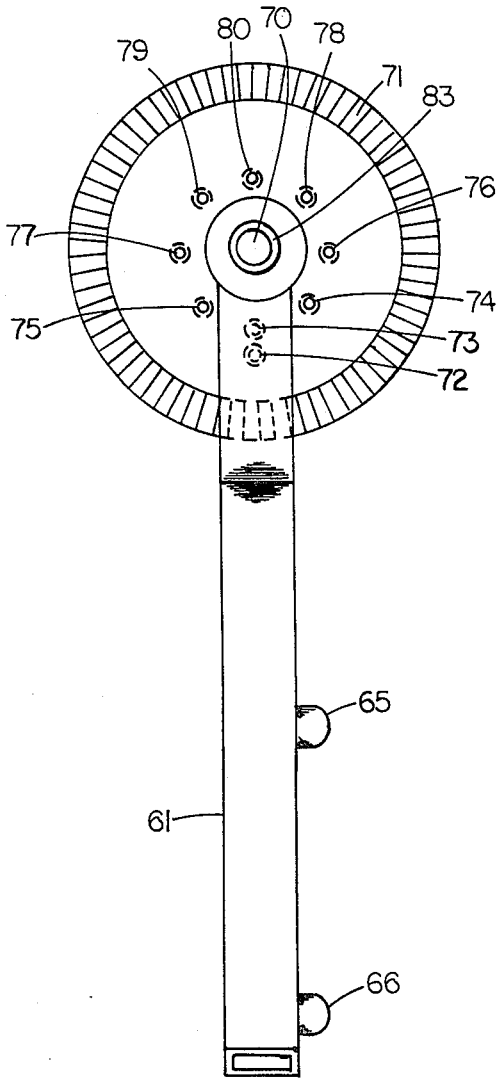
FIG. 5 is a front view of a brake drum having a protractor on its face and a series of adjustable contacts for closing a spring operated switch.

Rigidly mounted on section 31 is a post 70. On the latter just forward of section 31 is a brake drum 33 having a protractor 71 (FIG. 5) either molded or otherwise attached to the surface and a series of cams 72,73,74,75,76,77,78,79,80, which contact a pair of switches 151,152 (FIG. 4) which are connected to the energy source by a series of wires, 149,150, 153 and 164, a bearing, 81, is mounted on post 70 and fits into an opening, 82, of the brake drum, so that the drum is rotatable on post 70. The cams, 72–80, inclusive are threaded so that one or all can be moved forwardly to contact switches 151, 152, or the cams can be retracted to avoid contact with the switches if only exercise swings are taken.

For a left handed golfer cams 74,76,78 and 80 are operable for a backswing and in reverse order for the downswing.

For a right handed golfer cams 75,77,79 and 80 operate for the backswing and in reverse order for the downswing. Thus, it is possible to monitor a swing at about $\frac{1}{4}$, $\frac{1}{2}$, $\frac{3}{4}$ and full backswing and forward swing.

Figure 6:
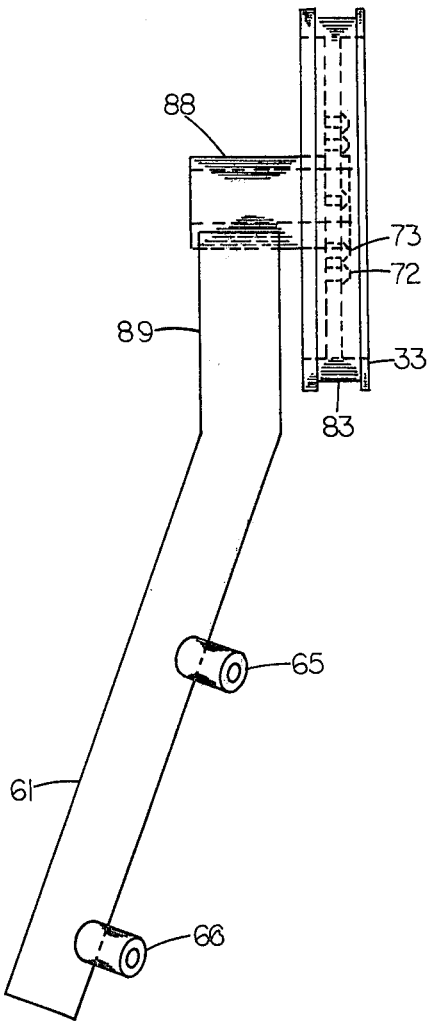
FIG. 6 is a side view of FIG. 5.

Cams 72 and 73 (FIGS. 5&6) operate at the point of impact of the club face with the ball, and signify whether or not a hit is "square."

The protractor indicates the degrees a club would travel from address to a complete back swing.

The brake drum has a groove 83 into which a brake band can be adjustably fitted, the brake band fits in a race, preferably metal, which is in the form of an arc of an ellipse along its long axis. Located below the brake band 84 is an adjustable screw 85 to adjust band tension against the brake drums. The tension controlling device is attached to section 31 by means of a bracket 86, having a threaded section 87.

Forward of the brake mechanism and rigidly attached thereto is a sleeve 88 which is rotatably mounted on post 70. The sleeve is rigidly attached to a bent section 89 of tubular swing arm 35 and has a bearing 90 on post 70.

Section 89 can be attached to the swing arm by means of a pair of perforate brackets 91, through which a nut and bolt, 92, can be secured to provide an adjustable member or it can be made rigid of a single piece, if desired.

Forward of sleeve 88 is a rod support 93 for a head restraining device 34. This can be an adaptation of a "hard hat" used as a protective device in industry. Rod support 93 is rigidly connected to post 70 by means of a headless screw 94.

A rod 95 is connected at one end to the rod support and at its other end to a bracket 96 rigidly attached to a side of the head restraining device 34.

A similar and identical bracket is attached to the opposite side of head restraining device. The bracket has a pair of perforate outwardly extending lugs 97,98 into which an arm 99 of the rod 95 is inserted. The bracket can be attached to the head restraining member by means of rivets, by an adhesive or screws or any other means for rigid attachment.

Optionally, bracket 96 can have a signalling device 100, including, but not limited to, a buzzer or an electrical lighting signal actuated through wires 101, 102 and, if desired, connected to quickly disconnected terminals, 103,104, which are connected to electrical contacts in terminal board 68 situated adjacent the battery holder.

Figure 7:
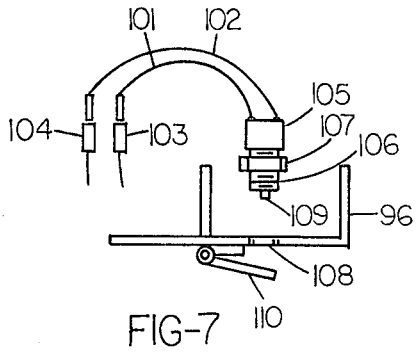
FIG. 7 is a switch member for operating a signal system in the head restraining device.

FIG. 7 shows one device which signals excessive head movement. It comprises a casing 105 for spring backed switch (not shown) which has contacts separated by the maximum amount of head movement permitted, usually 3–5 degrees. A headless screw 106 is held in the casing 105. A lock nut 107 is threaded on screw 106. The latter is screwed on to threaded opening 108 of bracket 96. A rod 109 is slidably mounted in a central opening of screw 106, and abuts against the spring backed switch in casing 105. Another spring member 110 connected to the bracket 96 on the portion facing the hat 34 and separated from the bracket by about 5 degrees faces the opening 108 in the bracket. On movement of the head, the spring 110 is compressed and forces rod 109 laterally to open the spring backed switch in casing 105 and cause an electrical current to cease flowing through wires 101 102 to cause signal light or other signalling device to cease functioning. If a buzzer is employed it is preferable to have a spring backed switch which will close and complete a circuit by excessive head movement, and thus cause the buzzer to sound.

If desired, one of the wires 101 or 102 can be attached to spring 110 and the other to screw 106 or rod 109 to complete the electrical circuit for the signalling device. In such instance it would be necessary to insulate the screw 106 from the wall of the bracket and a signal light would be turned on if excess head movement is made. Rod 95 fits into opening 111 of rod support 93.

Figure 8:
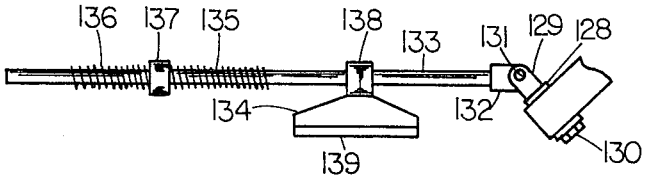
FIG. 8 is an exploded view of a signal box attached to a swing arm.
Figure 8:
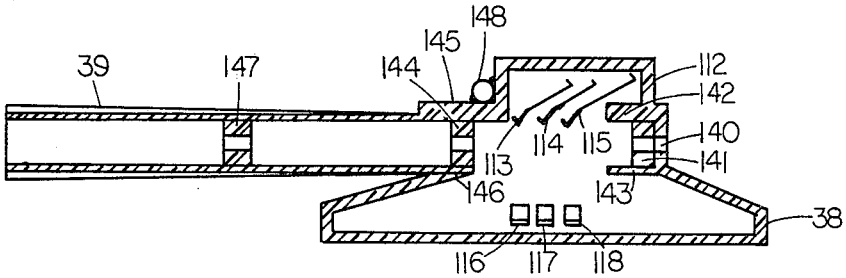
Figure 9:
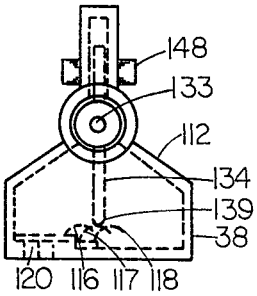
FIG. 9 is a front view of the signal box.
Figure 10:
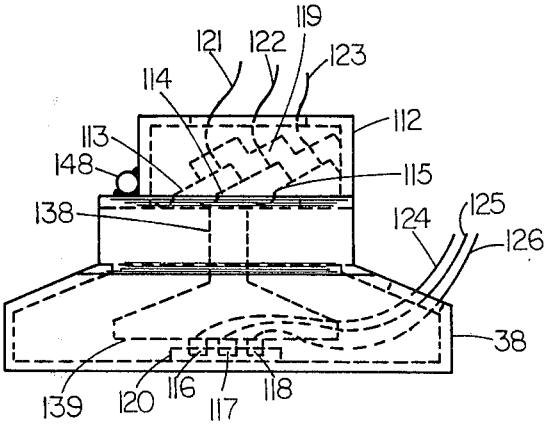
FIG. 10 is a detailed view of the switching arrangement in the signal box.

Referring now to FIGS. 8, 9, and 10 which are views of signal pack 38, 112 is a housing which contains signalling elements. Inside the pack are switch elements 113, 114, 115, 116, 117 and 118. The first three switches indicate movement of a club toward and away from a golfer. The latter three switches indicate rotary movement of the wrists. All switches are connected to insulators. It is preferable, by proper spacing of each trio of switches from each other to have a slight overlap in closing of the middle and one of the adjacent switches, but the switches can be spaced, so that only one of switches 113–115, inclusive and one of 116–118, inclusive, is closed at any one time. The advantage of a slight overlap is that the user can readily determine the direction of the hand and wrist movement needed to provide a correct address. The degree of overlap should preferably range from about ½ to about 2 degrees, so that there are no "black outs" or periods when the signals are not operating just prior to the proper address or just before contact with a simulated golf ball.

Switches 113, 114, 115 are separated from each other by an insulator 119 and switches 116, 117, 118 are separated by an insulator 120.

Switches 113, 114 and 115 are connected to wires 121, 122 and 123, respectively, and switches 116, 117 and 118 are connected to wires 124, 125 and 126, respectively. The wires from the signal pack are passed through or alongside the swing arm, preferably through a coil spring 127 (FIG. 1) from the signal pack, and through a similar coil spring 163 at the top of the device into a terminal board 68, if one is used or directly to a power source and then to signal device 58, either through an opening in the tubular support or on the outside of the support member.

Near the distal end of the swing arm 35 is an opening through which a rod 128 having a pair of perforated lugs 129 on one end and a threaded portion on the other is held in place by a nut 130 to form a swivel, 131; the swivel is attached to lugs 129 by means of a screw or rivet. The swivel is attached to a knuckle joint 132. Forward of the knuckle joint is a rod 133 which carries a cam 134, a pair of springs 135, 136 and a set collar 137.

Cam 134 has a narrow top portion 138 which serves to close spring or microswitches 113, 114 and 115 as described above and a relatively long and narrow bottom section 139 which serves to close spring or microswitches 116, 117 and 118.

The front face of housing 112 has an opening 140 against which a bushing 141 is placed between projections 142, 143. At the rear of the housing is a second bushing 144 at an opening defined by walls 145, 146. Spaced from bushing 144 in grip 39 is a third bushing 147.

When assembled rod 133 fits into opening 140, and bushings 141, 144 and 147, cam 134 which is fixed on rod 133 lies between the switches 113, 114, 115 and 116, 117 and 118. The springs 135, 136 and set collar 137 on rod 133 are between bushings 144 and 147. This arrangement provides for movement of a similated club face toward and away from a golfer. The rod turns to provide for rotation of the wrists of a golfer.

An optional and desirable adjunct, but one that is not essential, is to have a small liquid bubble level 148 mounted at the back upper surface of the signal pack housing. The level is useful to verify whether a club position is proper in that the display panel will have certain bulbs lit for a square hit when the liquid bubble shows a level position and, in addition, the level is useful to determine if electrical energy is passing through the signal system. An additional advantage of the level is that it will show misalignment of the signal system if lights other than the proper ones are lit.

Figure 13:
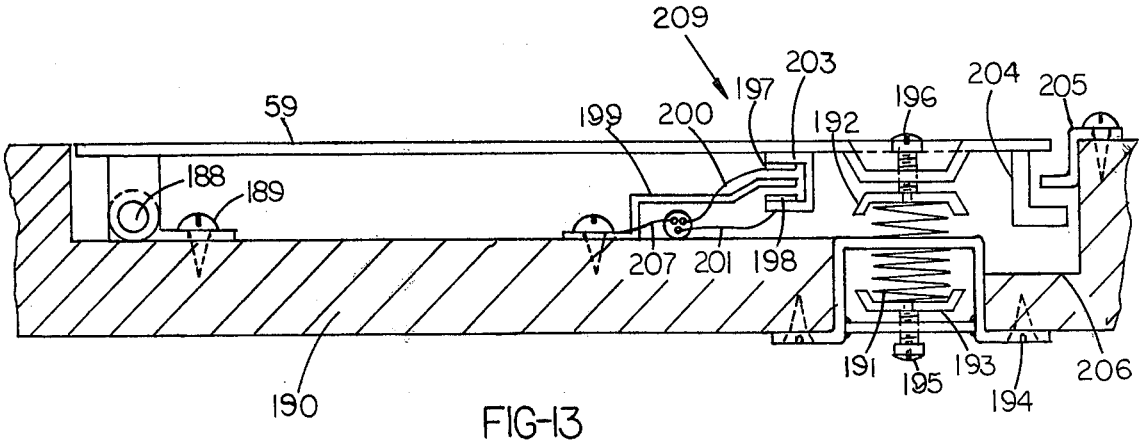
FIG. 13 is a side view of the weight shift signal device.

Referring to FIG. 13, this element comprises a plate 59, connected by hinge 188 and a screw 189 to a support 190. A spring 191, situated between upper bracket 192 and lower bracket 193, in holding member 194, can have one or two adjusting screws, 195, 196 for adjusting the tension so that the electrical circuit designated by contacts 199, 197 and 198 (defining a dual limit switch) is open when the golfer is in the addressing position. Upon making the proper weight shift onto the rear foot the plate 59 is depressed and contacts 197, 199 meet to close the electrical circuit. Current then passes through wires 200 and 208 to activate the cathode side of signal system. Also when the weight is shifted to the front foot of the user, the spring tension forces the plate 59 upwardly so that at the point of impact with a ball, contact 199 touches contact 198 to send a current through wires 201 and 208 to again activate the cathode side of the signal system. Thus only when the cathode side is activated will any of the signals operate.

The contacts are located in insulator 203. At the front of the weight shift member is a movement limiting arrangement comprising a bracket attached to the bottom of plate 59 and a second bracket 205 attached to support 190. A slightly depressed area 206 in support 190 limits downward movement and bracket 205 limits upward movement of plate 59.

Optionally, an on-off switch can be employed to cut out the weight shift signal when the user is in the address position for the purpose of effecting the proper foot placement and proper gripping of the grip 39.

THE SIGNAL SYSTEM

Figure 11:
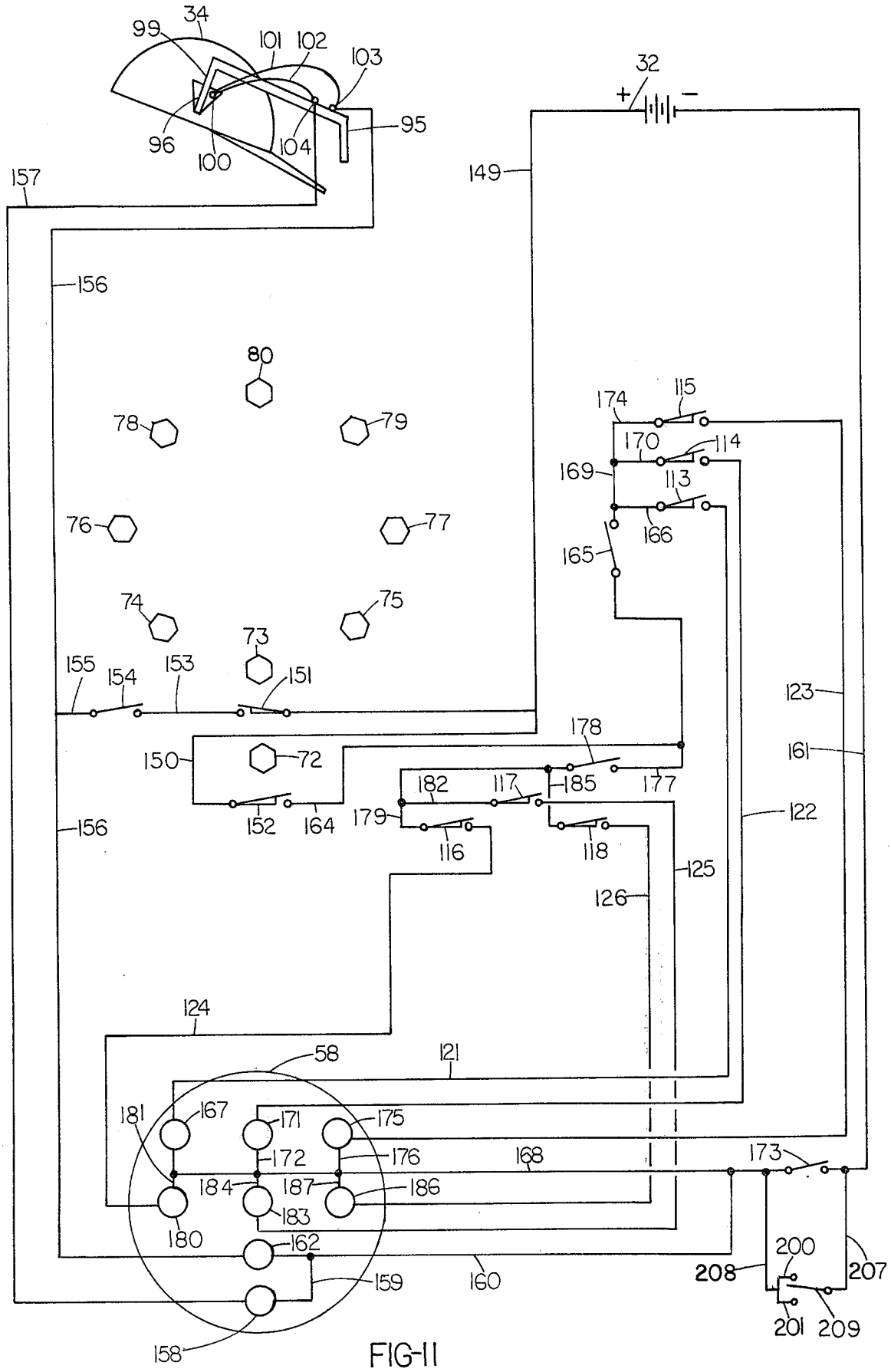
FIG. 11 is a wiring diagram for the swing signal system.

The signal system comprises a source of electrical energy which can be a household electrical outlet or a battery, the latter being 3 to 12 volts. FIG. 11 shows a wiring diagram for a battery operated system although the battery can be replaced by an ordinary electrical plug, if desired. For a completely portable golf swing perfecting and exercising device, it is preferable to use a battery as a source of the electrical energy.

A battery which can be held in holder 32 has an anode connected by wires 149, 150 to switches 151, 152 respectively. These switches are closed by contact with cams 73 and 72, respectively. One wire, 153, leads from switch 151 to on-off switch 154 and a line 155 connects with line 156 which leads to a fast disconnect member 103, 104 on bar 95 of the head restraining device. The fast disconnect member is connected to switch 105, (FIG. 7) by line 101. Line 102 is connected to line 157 to a bulb and socket 158, which in turn is connected to the battery cathode through lines 159, 160 and 161 and switch 173 or 209. The on-off switch 154, permits the operator of the device to either use the head restraining signal and the back swing and follow through signals, or omit the use thereof. Line 156 also connects with a bulb and socket 162. Line 160 leads to on-off switch 173 or 209 and line 161 to the battery.

From switch 152 wire 164 leads to on-off switch 165, which is connected to wire 166, leading to switch 113. Wire 121 from the housing leads to socket and bulb 167 and wire 168 and switch 173 or 209 to 161.

Line 169 connects with line 170, switch 114 and line 122 to bulb and socket 171. Line 172 connects with line 168 and switch 173 or 209 to 161.

Wire 174 connects with 169 and switch 115, and line 123 to bulb and socket 175. The latter is connected by line 176 to line 168, switch 173 or 209 and line 161.

The bulbs 167, 171 and 175 signal whether the club face is too far backward, in proper position, or too far forward with respect to the ball.

Wire 164 connects with wire 177 and on-off switch 178, which in turn is connected to wire 179, switch 116, wire 124, to bulb and socket 180. The latter is connected to wires 181, 168, switch 173 or 209 and line 161.

Wire 179 also connects with wire 182, switch 117 and wire 125 to bulb and socket 183, lines 184 and 168, switch 173 or 209 and line 161.

Attached to wire 179 is wire 185, connected to switch 118, wire 126 to bulb and socket 186, and line 187, line line 168, switch 173 or 209 and line 161.

It is to be understood that all the bulbs must be proper for the voltage used and in sockets suited to the purpose, and that lines 121–126, inclusive, and 156 and 157 can be connected to terminal board 68, if desired.

If one wishes only to strengthen a golf swing, it is only essential to adjust the tension on the brake mechanism by tightening the screw 85 (FIG. 4) to apply the proper tension against the brake drum 33, and grasping the grip 39 to move the swing arm 35 in accurate motion. The electrical systems can be in an off position for the exercising or golf swing strengthening action, but it is preferable to keep the electrical systems operative during the exercise cycles.

For improving or perfecting a golf swing to hit a golf ball squarely and at the proper elevation from the ground with consistency, the desired tension on the brake mechanism is applied, as described above, or the brake can be free of tension. The on-off electrical switches are all turned to "on" position. The golfer places his hands around grip 39 and adjusts his wrists and forward and backward hand motion and maintains his head substantially motionless until bulbs 158, 162, 171 and 183 are lit. If the hands are in proper position while addressing a golf swing, cam face 138 is in contact with switch element 114 to light bulb 171. This signal shows that the grip extension is in proper position relative to forward and backward status. If the grip extension is too far forward, cam 138 contacts switch element 115 and lights bulb 175 and if too far back, cam 138 contacts switch 113 to light bulb 167. In each of the instances when the grip extension is too far forward or back, light 171 is extinguished. When light 167 is on, it signals a "fat" hit and when light 175 is on, it signals a "light" hit.

For correct wrist position during a swing, cam face 139 contacts switch member 117 to light bulb 183. If the wrist is rotated to the left, cam 139 contacts switch element 116 to light bulb 180 instead of 183. This signifies that a swing results in a hook for a right handed golfer and a slice for a left handed golfer. If the wrist is moved to the right, cam 139 contacts switch element 118 to light bulb 186 instead of 183. This signifies a slice for a right handed golfer and a hook for a left handed golfer.

During the course of a back swing cam 73 closes switch 151 at address and on impact of a club face with a ball. As the club is raised the selected cams 74, 76, 78 and 80 will contact switch 151, to indicate that the selected back swing is completed. It is to be understood that only selected cams of the latter four need be placed in operative position.

In the down swing the relative order of contact of the cams 73, 74, 76, 78 and 80 with switch 151 will be in reverse order of those of the back swing. These positions of the cams represent $\frac{1}{4}$, $\frac{1}{2}$, $\frac{3}{4}$ and 4/4 of the swing until a club face meets a golf ball. Thus, if any signal lights other than 162, 171 and 183 become lit, the fault of the swing and the approximate position during the swing can be readily detected and corrective measure can be taken. For the follow through of a right handed golfer, cams selected from 75, 77, 79 and 80 will be operative. Thus, if there are any improper movements of hands or wrists too early in the follow through, that condition can be remedied.

For left handed golfers, the order of contact with the cams on the disc will be reversed as regards the back swing, down swing and follow through.

The head restraining signal light 158 is lit when switch 154 is in the "on" position. Movement of the head to a predetermined degree will cause the switch in the head covering or hat to open and bulb 158 will become extinguished. The device shown in the drawing is intended for use by right handed golfers. A similar unit on the opposite side of the hat would be operable for left handed golfers.

Thus, it is evident that if bulbs 158, 162, 171 and 183 are the only signals that become lit, the golfer has attained a simulated square and properly elevated hit of a golf ball. The swing can be improved or perfected by repeatedly making such hits through correction of errors designated by the signals developed in the panel lights.

It is to be understood that the above description is illustrative, but not limiting, except as defined by the claims herein, because there are numerous variations and modifications that can be made within the scope of my claims.

I claim:

1. A mechanism useful for improving a golf swing and for exercising muscles used in said swing comprising:

(a) a base member on which the mechanism is supported, (b) an upright member attached at the base, said upright member having a rigidly mounted post attached at its top to which post a swing arm and a brake adjustable as to tension are attached, (c) a signal pack on said swing arm having a rod carrying a cam said swing arm having a plurality of switches which are closeable by movement of said cam, each of said switches when closed activates a separate signal which individually can indicate (1) a movement of a simulated club toward and away from a golfer and (2) rotary movement of the wrists, said switches being connected to a source of electrical current said pack having at its distal end (d) a grip which is movable forwardly and backwardly to move said cam for closing certain of said switches and thereby activate electrical signal means, said grip also being movable laterally to simulate wrist action and to activate signals different from the signals activated by forward and backward movement, thereby denoting the position of a club face during a swing.

2. The mechanism of claim 1 in which the upright member is adjustable as to height.

3. The mechanism of claim 1 in which the swing arm is adjustable as to length to provide an effective inside/-outside swing.

4. The mechanism of claim 1 which has a head restraining member connected by a rod to said upright member.

5. The mechanisms of claim 4 which has an electrical signal operable by movement of the head beyond a predetermined degree.

6. The mechanism of claim 1 in which the brake comprises a rotatable drum having a race and a brake band in the form of an arc of an ellipse along its long axis, said brake being adjustable as to tension.

7. The mechanism of claim 1 in which the base member has a plurality of wheels attached thereto for easy portability and a plurality of leveling jacks to adjust the mechanisms on uneven surfaces.

8. The mechanism of claim 1 in which the base has a set of foot placement markings for the user.

9. The mechanism of claim 1 in combination with a weight shift signal element comprising a pivotal foot pad, an adjustable spring balanced mechanism which operates electrical switches upon predetermined and timely weight shift from one foot to the other, and in which the electrical circuit can be placed in series with other signals thereby precluding the operations of any signal unless the weight shift has been of the proper magnitude and time.

10. The mechanism of claim 9 in which the weight shift signal element is an integral part of the base.

11. The mechanism of claim 9 in which the signal element is independent of the base and is placed beneath said base as a separate element.

12. The mechanism of claim 1 in combination with a weight shift element comprising a pivotal foot pad, an adjustable spring balanced mechanism which operates an electrical switch to close an electrical circuit and to activate an electrical signal independently of other signals upon a predetermined and timely weight shift from one foot to the other.

13. The mechanism of claim 12 in which the weight shift signaling element is an integral part of the base.

14. The mechanism of claim 12 in which the weight shift element is independent of the base and is placed beneath said base as a separate element.

15. The mechanisms of claim 1 in which the handle is connected to the swing arm by means of a toggle and swivel.

16. The mechanism of claim 1 in which the signal pack has three electrical signals for signifying whether a club face is in correct position, too far forward or too far backward, three electrical switches for signalling whether the wrist motion is square, too far to the left or too far to the right, and means for closing the middle and only one adjacent switch of each trio of switches to provide a slight overlap, depending on the position of the hands and wrists.

17. The mechanism of claim 16 in which the means for closing the switches of each trio is a cam rotably mounted on a shaft, said cam having a relatively narrow top section for abutting against and closing a switch to denote forward and backward movement of the hands and a relatively long bottom section for abutting against and closing switches denoting wrist position.

18. The mechanism of claim 17 having a pair of springs coiled around a rod which carries a cam, said springs being located to the rear of said cam and separated by a collar.

19. The mechanism of claim 16 in which the switches are microswitches.

20. The mechanisms of claim 16 in which the switches are spring contacts.

21. The mechanism of claim 1 in which the signals are a plurality of electrical bulbs.

22. The mechanism of claim 21 in which the source of electrical current is a battery of 3 to 12 volts, inclusive.

23. The mechanism of claim 21 in which the source of electrical current is a 110 to 120 volt outlet.

24. The mechanism of claim 21 in which the electrical bulbs are mounted on a flat panel in sight of the user of the unit.

25. The mechanism of claim 1, having a liquid bubble level mounted on the signal pack casing.

* * * * *